United States Patent [19]

Schreier et al.

[11] 4,300,433

[45] Nov. 17, 1981

[54] HARMONY GENERATING CIRCUIT FOR A MUSICAL INSTRUMENT

[75] Inventors: Wilford R. Schreier, Bensenville; Horace E. Taylor, Skokie, both of Ill.

[73] Assignee: Marmon Company, Chicago, Ill.

[21] Appl. No.: 163,714

[22] Filed: Jun. 27, 1980

[51] Int. Cl.[3] ..... G10H 1/36; G10H 1/46

[52] U.S. Cl. ..... 84/1.17; 84/1.27; 84/DIG. 22

[58] Field of Search ..... 84/1.01, 1.03, 1.17, 84/1.24, 1.27, DIG. 12, DIG. 22

[56] References Cited

U.S. PATENT DOCUMENTS

| | | | |
|---|---|---|---|
| Re. 29,144 | 3/1977 | Bunger | 84/1.01 |
| 2,557,133 | 6/1951 | Mork | 84/1.17 |
| 3,247,310 | 4/1966 | Stinson, Jr. | 84/1.17 |
| 3,629,480 | 12/1971 | Harris | 84/1.03 |
| 3,711,618 | 1/1973 | Freeman | 84/1.03 |
| 3,717,715 | 2/1973 | Jordy | 84/1.17 |
| 3,839,592 | 10/1974 | Freeman | 84/1.01 |
| 3,844,192 | 10/1974 | Brand et al. | 84/1.01 |
| 3,889,568 | 6/1975 | Amaya | 84/1.01 |
| 4,072,078 | 2/1978 | Shallenberger et al. | 84/1.03 |
| 4,205,576 | 6/1980 | Deutsch et al. | 84/1.17 |

*Primary Examiner*—S. J. Witkowski

*Attorney, Agent, or Firm*—Neuman, Williams, Anderson & Olson

[57] ABSTRACT

A harmony generating circuit generates high harmony signals in response to coincident lower manual accompaniment signals and upper manual melody signals. Gating circuitry responsive to coincident inputs from accompaniment chords played on the lower manual and melody notes played on the upper manual generate harmony notes on the upper manual which correspond to the accompaniment notes played on the lower manual but are above the melody notes and approximately within one octave of the melody notes.

5 Claims, 2 Drawing Figures

HARMONY GENERATING CIRCUIT FOR A MUSICAL INSTRUMENT

BACKGROUND OF THE INVENTION

This invention relates generally to electronic musical instruments and more particularly, to an electronic organ including circuitry for generating harmony signals in the octave above a four note group which includes a melody note played on the upper manual of an electronic organ.

It has always been desirable from a musical standpoint for an organist to include harmony notes below the melody being played upon the upper manual and related to the chords being played upon the lower manual. While playing such harmony signals requires great manual dexterity and concentration, many professional organists frequently use the technique to enhance and complement the music being played. An amateur organist is rarely able to master such a complicated playing technique but would nevertheless like to enhance the music being played to the same degree as the professional organist.

To satisfy the need of providing the beginning organist with the capability of playing harmony notes below the melody being played, various automatic harmony systems have been developed and are available in prior art devices. Often times these systems incorporate complex and cumbersome arrangements of mechanical switching devices to generate harmony signals in response to the depression of keys on both a lower manual or accompaniment manual and an upper manual or a melody manual. Electronic circuitry including digital circuitry, has been provided to generate such harmony additions in electronic organs. These automatic harmony signals enable the organist to perform what otherwise is a complex maneuver of incorporating harmony signals on the upper manual to co-ordinate with the signals generated on the lower manual.

Harmony generation circuits as described above are common in the prior art and each of these harmony circuits generates harmony signals an octave below the melody note played on the upper manual. The tonal relationship of providing harmony signals in the octave below the melody note and related to the chord being played on the lower manual is well known in the musical arts and is known to create a pleasing musical effect.

Manufacturers of electronic organs have implemented circuitry to perform such well known musical techniques as the generation of harmony signals in the octave below the melody note played on the upper manual of an electronic organ. However, such harmony signals tend to "muddy" or degrade the sounds generated by an electronic organ since lower pitch harmony signals are added and the harmonics from the individual notes being sounded on the upper manual tend to clash as the notes get lower in pitch.

SUMMARY OF THE INVENTION

In accordance with the present invention, harmony signals are generated in response to lower manual chording signals and an upper manual melody note. However, the harmony signals are generated above the upper manual melody note within approximately one octave. Such high harmony signals delay the sound from the organ from becoming "muddy" until lower pitch melody notes are played since higher pitch harmony signals are used. The use of these high harmony signals accordingly extends the effective range of melody notes played on the upper manual to lower pitch notes.

A harmony generating system is included in an electronic organ having a lower manual for generating lower manual keying signals and an upper manual for generating upper manual keying signals. Isolation diodes are connected to the upper manual for coupling the upper manual keying signals through the harmony generating system to upper manual output terminals. A logic circuit is coupled to both the upper and lower manuals for generating harmony signals on the upper manual output terminals which correspond to the lower manual keying signals but are approximately one octave above the upper manual keying signals. Voltage control circuitry is included for controlling the relative magnitudes of the upper manual keying signals and the harmony signals such that the upper manual keying signals are greater in magnitude than the harmony signals whereby the musical notes played in direct response to the upper manual keying signals are accentuated.

BRIEF DESCRIPTION OF THE DRAWING

For a more complete understanding of this invention, reference should now be made to the embodiment illustrated in greater detail in the accompanying drawing and described below by way of example of the invention. In the drawing.

DETAILED DESCRIPTION OF THE ILLUSTRATIVE EMBODIMENT

Figure 1:
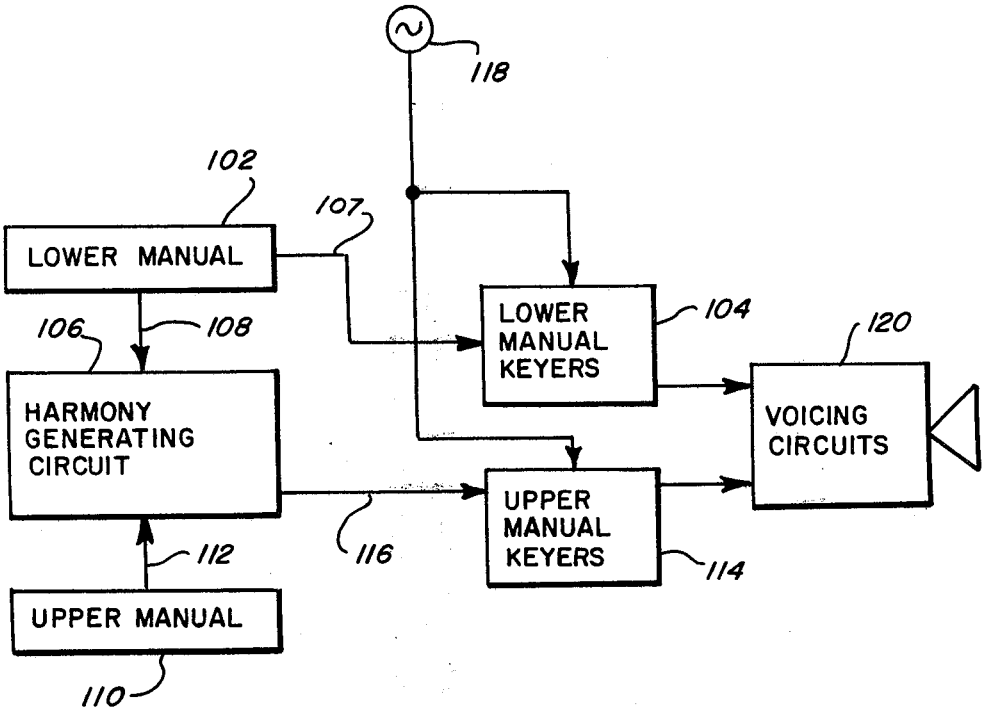
FIG. 1 is a block diagram of an organ incorporating the harmony generating circuit in accordance with the present invention.

FIG. 1 is a block diagram of an electronic organ which includes the harmony generating system of the present invention. An organist normally plays accompaniment notes or chords with the left hand on a lower manual 102. The lower or accompaniment manual 102 includes a plurality of keys, each of which generates a keying signal when depressed by the organist. The depression of more than one key on the accompaniment manual generates a corresponding number of keying signals. The lower manual keying signals are passed to lower manual keyers 104 on the conductors 107. Lower manual keying signals are also passed to the harmony generating circuit 106 via the conductors 108.

The organist normally plays melody notes with the right hand on an upper or melody manual 110. The upper manual 110 comprises a plurality of keys which span several octaves of frequency. The depression of each of these keys by the organist generates upper manual keying signals in the same manner as the accompaniment manual. The upper manual keying signals are passed on the conductors 112 to the harmony generating circuit 106. The upper manual keying signals are directly passed to upper manual keyers 104 via isolation diodes 148 in the harmony generating circuit 106 (see FIG. 2) on the conductors 116.

The harmony generating circuit 106 in accordance with the present invention generates upper manual harmony signals in response to both the lower manual and upper manual keying signals. The upper manual harmony signals from the harmony generating circuit 106 are reduced in magnitude in comparison to the upper manual or lower manual keying signals and are passed to the upper manual keyers 114 together with the upper manual keying signals via the conductors 116.

The lower manual keyers 104 and the upper manual keyers 114 receive tone signals of various frequencies from the top octave generator and divider circuit 118. The lower manual keyers 114 pass tone signals selected by the lower manual keying signals to the voicing circuits 120 which generate the audible music tones. Similarly the upper manual keyers 114 pass tone signals selected by the upper manual keying signals and the harmony signals to the voicing circuits 120. The tone signals generated in response to the upper manual keying signals are accentuated relative to the tone signals generated in response to the harmony signals due to the voltage differential previously described.

Figure 2:
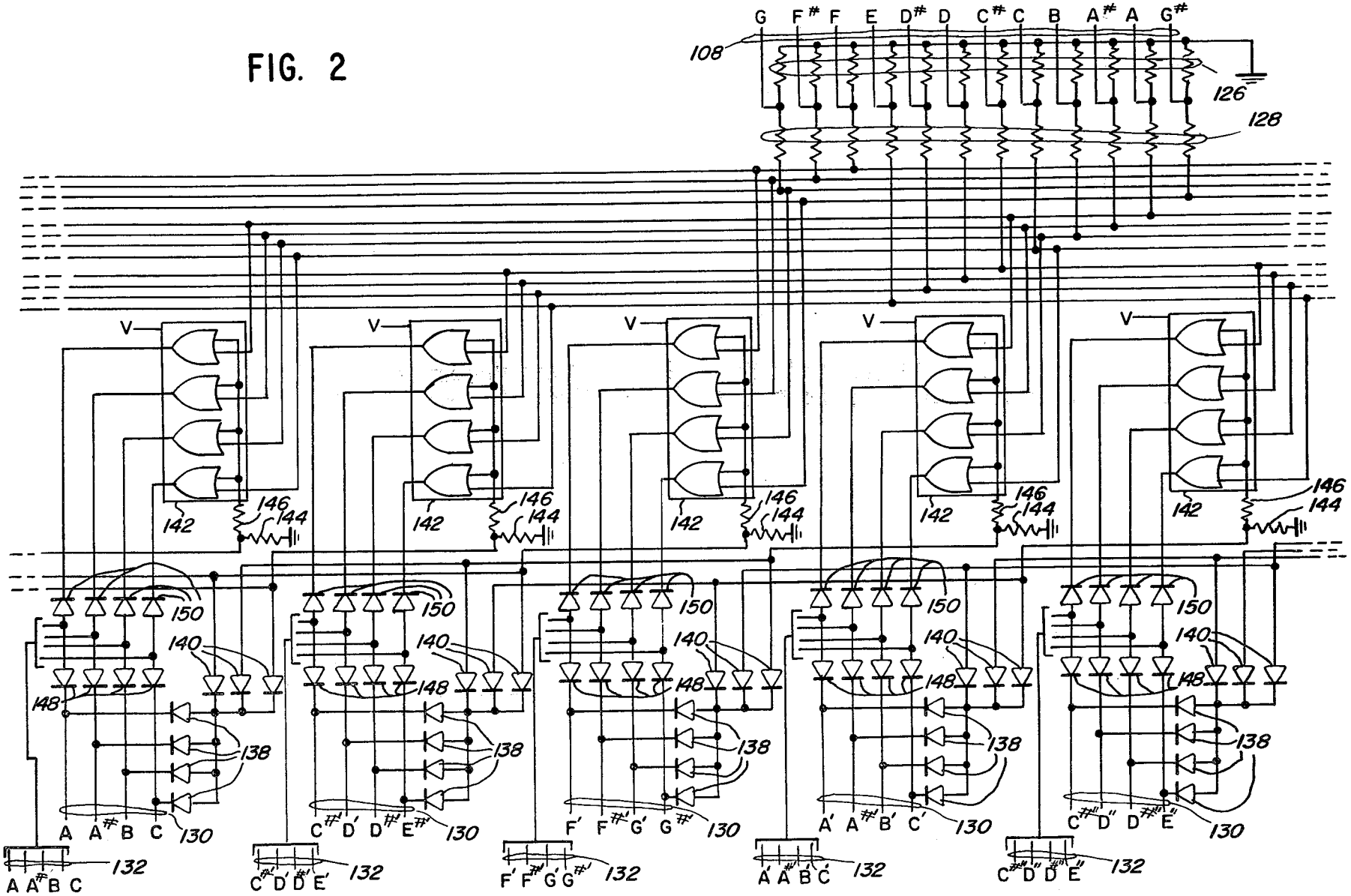
FIG. 2 is a schematic diagram of an illustrative portion of the harmony generating circuit of FIG. 1.

FIG. 2 is a schematic diagram of the central portion of the harmony generating circuit 106 of FIG. 1. Only the central portion of the circuit is shown since connections within the circuit are repetitive and can be extended to either lower octave notes or higher octave notes as desired or necessary. Typically, harmony signals will be only partially provided for the highest octave of the upper manual due to the fact that the higher octave notes required for generating such harmony signals are not available on the organ. Provision for partial high harmony signals is a straight forward extension of the circuitry of FIG. 2 to available higher octave notes with the omission of circuitry for higher octave notes which are not provided. Of course, a complete high harmony system can be provided by generating the additional higher octave notes required. Such extensions and changes will be clear to one of ordinary skill in the art in view of the teachings herein.

The keying signals from the lower manual 102 are provided on the conductors 108 of the harmony generating system 106 as shown in FIG. 2. If any alphabetic note key in any octave of the lower manual is depressed, the corresponding alphabetic input signal on the conductors 108 goes to a low voltage level. The individual alphabetic note indications are identified on the conductors 108 in FIG. 2. The individual keying signals for the different octaves of each alphabetic note are connected via diodes to the conductors 108 to provide isolation and to prevent cross-coupling between the keying signals from the lower manual 102.

The resistors 126 are connected between the input conductors 108 from the lower manual 102 and ground potential and raise the voltage levels on those input conductors to ground potential when no signal is present from the lower manual 102. The resistors 128 are current limiting resistors and limit the flow of current in the harmony generating circuit 106.

Individual keyer signals from the upper manual 110 are provided on the conductors 112. The conductors 112 are arranged into conductor groups 130 of four as shown in FIG. 2. Upper manual keying signals and harmony signals to the upper manual keyers 114 are provided on the conductors 116 which are grouped into corresponding conductor groups 132 of four. The inputs on the conductor groups 130 of the conductors 112 and the outputs on the conductor groups 132 of the conductors 116 for one octave of notes of the upper manual 110 are provided on the center three groups of conductors and designated as the primed octave of notes, the next lower octave being unprimed and the next higher octave being double primed as shown in FIG. 2. The operation of this octave of upper manual notes will be described as representative of the other octaves of upper manual notes since the structures of the harmony generating circuit 106 is repetitive in nature.

The depression of any key in the upper manual places a low voltage signal on its corresponding input of the conductor groups of 130 of the conductors 112. These inputs are connected by the diodes 138 or "diode ored" and routed to the isolating diodes 140. The isolating diodes 140 are interconnected so that a low voltage signal on one or more of the four input conductors of a given one of the groups of input conductors 130 passes an activating signal to the three higher groups of OR gates 142. These activating signals are controlled by the pull up resistors 144 and the current limiting resistors 146 in a manner similar to that described for the resistors 126 and 128 with reference to the lower manual input signals.

Activating signals from the upper manual 110 are passed from the input conductors 130 to the output conductors 132 directly via the isolation diodes 148. Thus, for each activated key of the upper manual 110, a keying signal of approximately the same voltage level is passed to the upper manual keyers 114 on the conductor groups 132 which make up the conductors 116. The supply voltage V for the gate OR gate groups 142 is a lower voltage than the voltage provided by the upper manual 110 and the lower manual 102. The higher voltage signals from the upper manual 110 and the lower manual 102 are current limited by the resistors 146 and 128 respectively to be compatible with the OR gate groups 142. However, the OR gate groups 142 provide an output voltage which is approximately equal to V, a substantially lower voltage than that provided by the upper and lower manuals. The output signals from the OR gate groups 142 are passed to the output conductors 132 making up the conductors 116 via the isolating diodes 150. The OR gate groups 142 are activated by corresponding signals from the upper manual via the conductors 130, the diodes 138 and 140, the resistors 146; and the signals from the lower manual on the conductors 108 via the resistors 128 and the various conductor paths leading to the OR gate groups 142.

The above described harmony circuit 106 generates harmony signals for the upper manual keyers 114 which are approximately one octave higher than an upper manual note being played and correspond to the alphabetic notes being played on the lower manual. The following example will further illustrate the operation of the harmony circuit 106. It will be presumed that the operator plays a single note in the primed octave of notes C#′ through C′ on the upper manual 110 and a corresponding major chord on the lower manual 102. For example, assume that the operator is playing the major chord C#, F, G# on the lower manual. It is noted that the octave in which the chord is being played is irrelevant since all octaves of each alphabetic note energize the same input line of the harmony circuit 106 as previously described. The organist then plays the C# note on the upper manual which activates the C#′ input of the corresponding group of conductors 130 which is passed to the C#′ output via the corresponding isolation diode 148. This active input is also passed through the C#′ isolation diode 138 and the C#′ through E#′ isolation diodes 140 to the OR gate groups 142 corresponding approximately to the next higher octave of notes, i.e., F′ through G#′, A′ through C′ and C#″ through E″. The three gates corresponding to C#, F and G# are activated by the coincident inputs from the upper manual and the lower manual to generate upper manual harmony signals C#'', F' and G#' which are passed to the upper manual keyers 114 and correspond to the chord being played on the lower manual but in the octave above C#' which is the note being played on the upper manual.

In accordance with the above teachings, it will be apparent that a harmony generating system has been described for generating harmony signals on the upper manual which correspond to lower manual accompaniment but are approximately one octave above melody notes played on the upper manual. Although only a single embodiment has been disclosed, alternate embodiments and modifications will be apparent to those skilled in the art. For example, note groupings other than 4 could be used. If each of the upper manual notes were treated individually the upper manual harmony signals would sound the notes in the octave above a given melody note rather than in the octave above a note group which includes the upper manual note. Such alternate embodiments and modifications are considered to be equivalents of the present invention and within the true spirit and scope of the invention as claimed in the following claims.

What is claimed is:

1. A harmony generating system for use in an electronic organ having a lower manual for generating lower manual keying signals and an upper manual for generating upper manual keying signals, said harmony generating system comprising:

first means including output terminals connected to said upper manual for coupling said upper manual keying signals to said output terminals;

second means connected to said upper and lower manuals and to said first means for generating harmony signals in response to said upper manual keying signals and said lower manual keying signals, said harmony signals directly corresponding to said lower manual keying signals, being one octave above said upper manual keying signals and being provided on said output terminals; and third means connected to said second means for controlling the relative magnitude of said upper manual keying signals and said harmony signals such that said upper manual keying signals are greater in magnitude than said harmony signals to accentuate the musical notes played in response to said upper manual keying signals.

2. The harmony generating system of claim 1 wherein said first means comprises isolating diodes.

3. The harmony generating system of claim 2 wherein said second means comprises gating circuitry.

4. The harmony generating system of claim 3 wherein said third means comprises voltage control circuitry to maintain the voltage level of said harmony signals below the voltage level of said upper manual keying signals.

5. The harmony generating system of claim 1 wherein said upper manual keying signals are divided into groups of four, said second means being grouped into groups of four to generate said harmony signals with each group of upper manual keying signals driving the three immediately succeeding higher frequency groups of said second means whereby said harmony signals correspond to said lower manual keying signals but are one octave above the four note groups which include active upper manual keying signals.

* * * * *